US005958518A

United States Patent [19]

Sippola

[11] Patent Number: 5,958,518

[45] Date of Patent: Sep. 28, 1999

[54] METHOD OF PRODUCING HOT-DIP ZINC COATED STEEL SHEET FREE OF DROSS PICK-UP DEFECTS ON COATING AND ASSOCIATED APPARATUS

[76] Inventor: Perti J. Sippola, Kiiltokalliontie 31, Espoo, Finland, 02810

[21] Appl. No.: 09/015,551

[22] Filed: Jan. 29, 1998

[51] Int. Cl.[6] ..... B05D 1/18; B05C 3/04

[52] U.S. Cl. ..... 427/433; 427/434.4; 427/434.5; 118/419; 118/424; 118/429

[58] Field of Search ..... 427/433, 434.4, 427/434.5; 118/429, 419, 424

[56] References Cited

U.S. PATENT DOCUMENTS 3,887,721 6/1975 Schwieterman ..... 427/433

4,971,842 11/1990 Sippola ..... 427/433

OTHER PUBLICATIONS

Dross Formation and Flow Phenomena in Molten Zinc Bath; C. Kato, H. Mochizuki and N. Morito; Galvatech '95 Conference Chicago, 1995; pp. 801–806 (No Month date).

*Primary Examiner*—Katherine A. Bareford
*Attorney, Agent, or Firm*—Robert G. Lev

[57] ABSTRACT

The present invention relates to a system and a method for using the system to provide a dross-free zinc bath for hot-dip galvanizing of steel strip or wire. The system includes the operation and apparatus for carrying out the operation of directing a zinc solution directly against both sides of a steel strip, along at least 50% of the processing length of the strip.

16 Claims, 5 Drawing Sheets

TEMPERATURE /°C
540
530
520
510
500
490
480
470
460
450
440
540°C ±5°C
STRIP IMMERSION TEMPERATURE
STRIP IMMERSION TEMPERATURE
485°C
BATH TEMPERATURE
447°C ±7°C

IRON-CONTENT IN BATH WT-%
.030
.025
.020
.015
0.030 wt-%
PRIOR ART
0.025 wt-%
SOLUBILITY OF IRON
AT 447°C
THE INVENTION
INVENTION

DROSS-% IN COATING
3
2
1
PRIOR ART
INVENTION
DROSS-FREE
PRODUCT
THE INVENTION
COIL #1
COIL #2
COIL #3
COIL #4
COIL #5
COIL #6
1 HOUR
TIME

METHOD OF PRODUCING HOT-DIP ZINC COATED STEEL SHEET FREE OF DROSS PICK-UP DEFECTS ON COATING AND ASSOCIATED APPARATUS

TECHNICAL FIELD

The present invention relates to a method for controlling the deposition of a metallic layer on a continuous steel product, such as a strip or wire, in a continuous hot-dip galvanizing process. In particular, the present invention is directed to a system and a method to perform dross-free hot-zinc coated steel coating.

BACKGROUND OF THE INVENTION

In recent years there has been increasing use of hot-dip zinc coated and galvannealed steel sheet in automotive body panels, and other related structures. A cold-rolled steel strip can be given a good formability by means of a heat treatment such as that disclosed in U.S. Pat. No. 4,361,448 (incorporated herein by reference). In this process, after annealing at a temperature $T_1$ (720° to 850° C.) the steel strip is slowly cooled to a temperature $T_2$ (600° to 650° C.). At this point the steel is rapidly quenched in a zinc bath to a temperature $T_3$. The time interval for revealing the temperature between $T_2$ and $T_3$ is about 0.5 seconds.

In the arrangement of the U.S. Pat. No. 4,361,448 a zinc bath and a zinc pump, with nozzles, are used. Molten metal having the same temperature as the zinc bath is pumped through a spout to the immersion point of the steel strip. As a result the end temperature $T_3$ of the rapid cooling process is rather high, and the steel strip does not reach the temperature of the zinc bath during the entire immersion time (about two seconds).

A steel strip traveling through a zinc bath causes a laminar zinc flow following the surface of the steel strip. The heat from inside the steel strip raises the temperature of the laminar zinc flow (layer) to a value higher than the operating temperature of the zinc bath. Iron and zinc react strongly in a conventional zinc bath (containing 0.15 to 0.25% aluminum) at temperature above 480° C. This results in a thick intermetallic layer formed on the zinc coating.

In order to achieve a good formability of the zinc coating, the intermetalic layer should be as thin as possible. In the method disclosed in U.S. Pat. No. 4,971,842 (incorporated herein by reference), the thickness of the intermetallic layer is controlled by rapidly cooling the steel product. This is accomplished by quenching the steel in a bath of molten zinc, and controlling the structure of the coating to be formed on the steel product in the quenching by directing a flow of molten zinc, cooled to a temperature below the operating temperature of the zinc bath, toward the steel product as it moves through the zinc bath.

Preferably the first flow of molten zinc is directed towards the steel product close to the immersion point thereof and obliquely to the movement direction of the steel product by means of a set of first nozzles. A second flow of cooled molten zinc is directed essentially perpendicularly toward the steel product at a point after said obliquely directed flow, by means of a second set of nozzles.

The flow of molten zinc directed towards the steel product is cooled by means of a heat exchanger cooler, preferably to a temperature 1° to 15° C. below the operating temperature of the zinc bath. The flow of zinc through the cooler to the nozzles is kept separate from the rest of the zinc bath. The essential feature of locally cooling the zinc bath is the additional important advantage that the iron content of the zinc bath is lowered.

The iron content of a zinc bath used, in a continuous hotdip galvanizing process of thin steel sheet is generally at the saturation point. Even a small change in the temperature causes a precipitation of iron and zinc. This occurs either at the bottom of the bath or as a drift of precipitates onto the surface of the steel strip to be galvanized, which impairs the quality of the coating.

Thus, to maintain a good quality, variations in the temperature of the zinc bath should be avoided. Therefore, some galvanizing lines are provided with separate pots for the preliminary melting of zinc so that the melting temperature of the zinc to be added would not change the temperature of the zinc bath.

The solubility of iron in molten zinc is generally a linear function of the temperature. At normal galvanizing temperature of approximately 455° C., the iron content is about 0.040%, while at a temperature of about 440° C. the iron content is about 0.015%. To improve the quality of a hot-dip galvanized thin steel sheet, dross, such as Fe⁻Zn precipitates (slag particles), on the zinc coating must be avoided. Thus, it is advantageous to lower the iron content in the zinc bath from a saturated state, so that use of different galvanizing temperatures is possible without precipitation of very small Fe—Al—Zn particles from the molten zinc. These particles are a combination of bottom dross ($FeZn_7$) and top dross ($Fe_2Al_5$). These particles are discussed in greater detail in the publication by Kato et al., entitled *Dross Formation and Flow Phenomenon in Molten Zinc Bath*, Galvatech '95 conference proceedings, Chicago, 1995, pages 801–806. This publication is incorporated herein by reference as background material elaborating upon the nature of the types of dross particles that are formed in the environment in which the present invention operates. When the zinc flows toward the steel strip, small Fe—Al—Zn particles adhere as an even layer to the surface of the steel product and leave the zinc bath as a part of the zinc coating.

To keep the Fe—Al—Zn particles as small as possible and homogeneously distributed, the temperature and the rate of the zinc flow should preferably be at constant value. The heat loss caused by the zinc cooler can be compensated by adjusting the speed of the steel product the temperature of which is higher than the temperature of the zinc bath.

A major problem with the operation disclosed in U.S. Pat. No. 4,971,842 is dross-pick up on the strip during the hot-dip coating process due to the suspended dross in the bath. The presence of dross particles of Fe—Zn and Fe—Al intermetallics within coating is of particular concern. First, stamping and forming operations can cause some "print-through" and other defects that show up in the painted appearance of the product. This is of particular concern when the steel is used in the automotive and appliance end-user areas. In particular, galvanized surface blemishes, attributable to dross particles, become highlighted when high gloss paint finishes are applied on them.

The dross particles can also cause operational problems when they build-up on the sink roll (element 4 in FIG. 1). This necessitates down-grading the steel product to less critical categories, and/or shutting the line down periodically to clean or change the affected roll results in lost production.

Even if perfect zinc bath chemistry management using conventional galvanizing technologies is conducted, dross crystallization is unavoidable due to aluminum addition, iron dissolution from the steel strip, insufficient temperature uniformity, and insufficient chemical bath homogeneity. The dross pick-up problem can theoretically be avoided only if the coating is performed with a dross free zinc bath composition.

While the system described in U.S. Pat. No. 4,971,842 has improved the temperature uniformity of the bath, chemical homogeneity has not been sufficiently improved. However, when the zinc flows towards the steel strip, small Fe—Al—Zn particles adhere as an even layer to the surface of the steel product and leave the zinc bath as part of the zinc coating. This is due to the insufficient performance of the second flow from a second set of nozzles towards the steel strip. Also, the flow pattern as shown in FIG. 1 is insufficient to provide chemical homogeneity of the zinc bath. This situation exists because the volume of the whole bath is insufficiently agitated throughout it's entirety thereby allowing some local accumulation of dross within the bath. Also, this and the conventional systems do not provide sufficient cleaning of the zinc roll (element 4 in FIG. 1). As a result, dross build-up on the roller surface cannot be prevented without a mechanical scrapper, which presents it's set of problems.

Thus, while the cooler described in the U.S. Pat. No. 4,971,842 does decrease the amount of dross particles in the zinc bath, it cannot provide perfectly dross free bath composition and dross free coating. The conventional art has also failed to adequately address the problem of dross control within hot-dipped galvanized processes, so that a cooler/cleaner system and process that can do so is very desirable.

SUMMARY OF THE INVENTION

Consequently it is an object of the present invention to perform virtually dross-free hot-zinc coating of steel strips.

It is a further object of the present invention to carry out hot-dip zinc coating of steel in a virtually dross-free bath.

It is another object of the present invention to eliminate or drastically reduce "print-through" defects on zinc coated steel strips due to dross formed in a hot-dip bath.

It is still an additional object of the present invention to eliminate problems related to dross build-up on sinker rollers in a hot-dip zinc bath used for coating steel strips.

It is yet another object of the present invention to specifically control the amount of zinc flowing against the steel strip used in a hot-dip galvanizing process.

It is yet a further object of the present invention to provide a more consistent coating of zinc on steel strip in a hot-dip bath galvanizing process than has been possible in conventional hot-dip galvanizing processes.

It is still another object of the present invention to provide a method of effectively cleaning a sink roller without mechanical scrappers in a zinc bath used for a hot-dip steel galvanizing process.

It is yet an additional object of the present invention to provide chemical homogeneity in a zinc bath used in a hot-dip galvanizing system for steel strip, thereby eliminating the local accumulation of dross in "dead" zones.

These and other objects and advantages of the present invention are achieved by a method of hot-dipped galvanizing that eliminates substantially all dross generated by galvanizing metal to be coated. This method includes the step of inserting metal into a zinc bath and adhering substantially all of the dross generated in the zinc bath to the metal.

Another embodiment of the present invention is a galvanized steel product formed by the process of dipping steel in a hot zinc bath and adhering substantially all of the dross generated in the zinc bath to the steel.

A third embodiment of the present invention is manifested by a system for carrying out hot-dipped steel galvanizing in a zinc bath while maintaining the zinc bath in a substantially dross-free state. The system includes flow means for directing substantially all of the dross to adhere to the steel being coated.

BRIEF DESCRIPTION OF THE DRAWINGS

FIG. 2(*b*) is a schematic diagram depicting a front view the side view of the molten zinc flow control device.

DESCRIPTION OF THE PREFERRED EMBODIMENTS

Figure 2A:
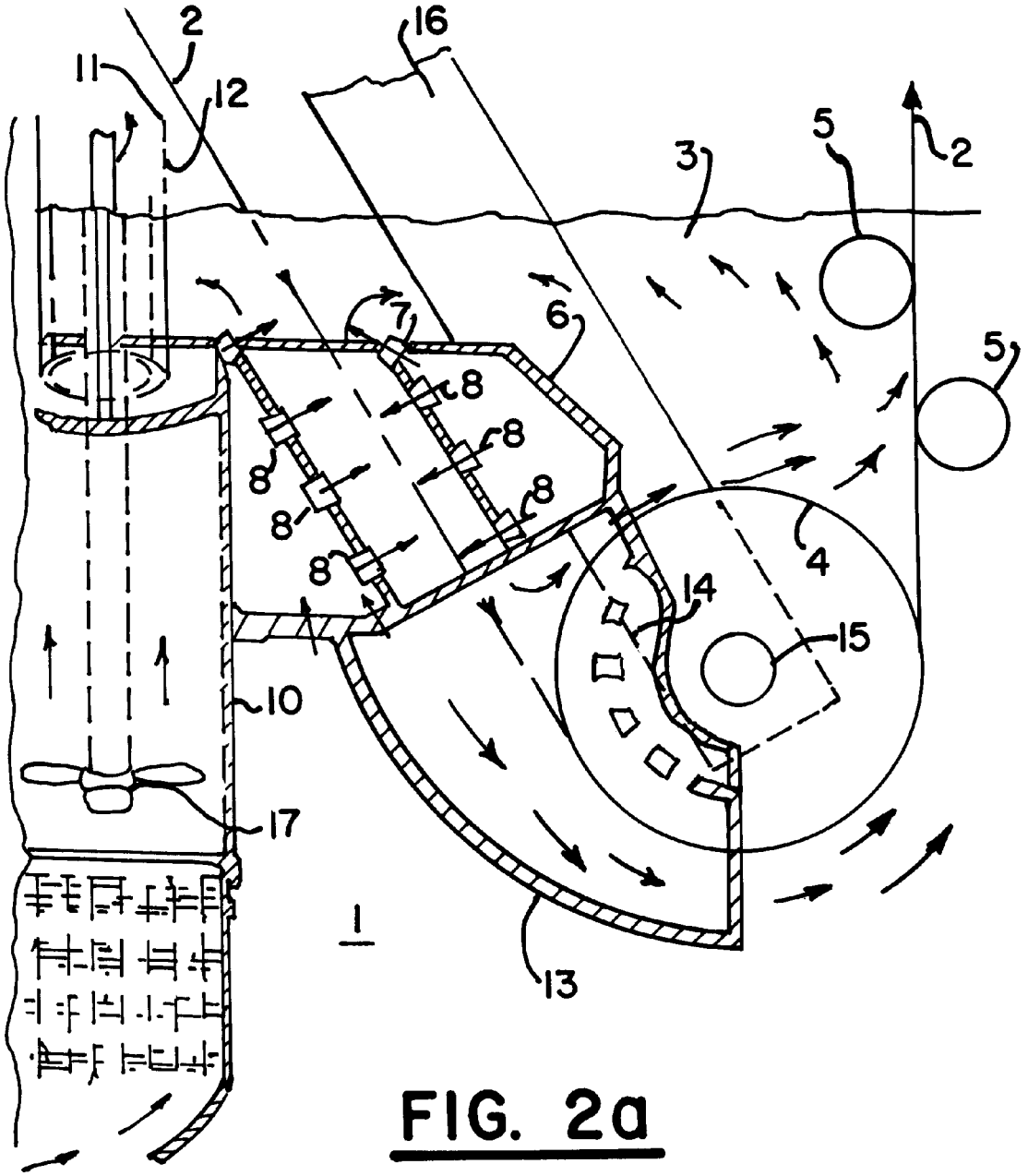
FIG. 2(*a*) is a schematic diagram depicting a side view of the cooler/cleaner of the present invention, and the new flow pattern occupying with the inventive method.
Figure 2B:
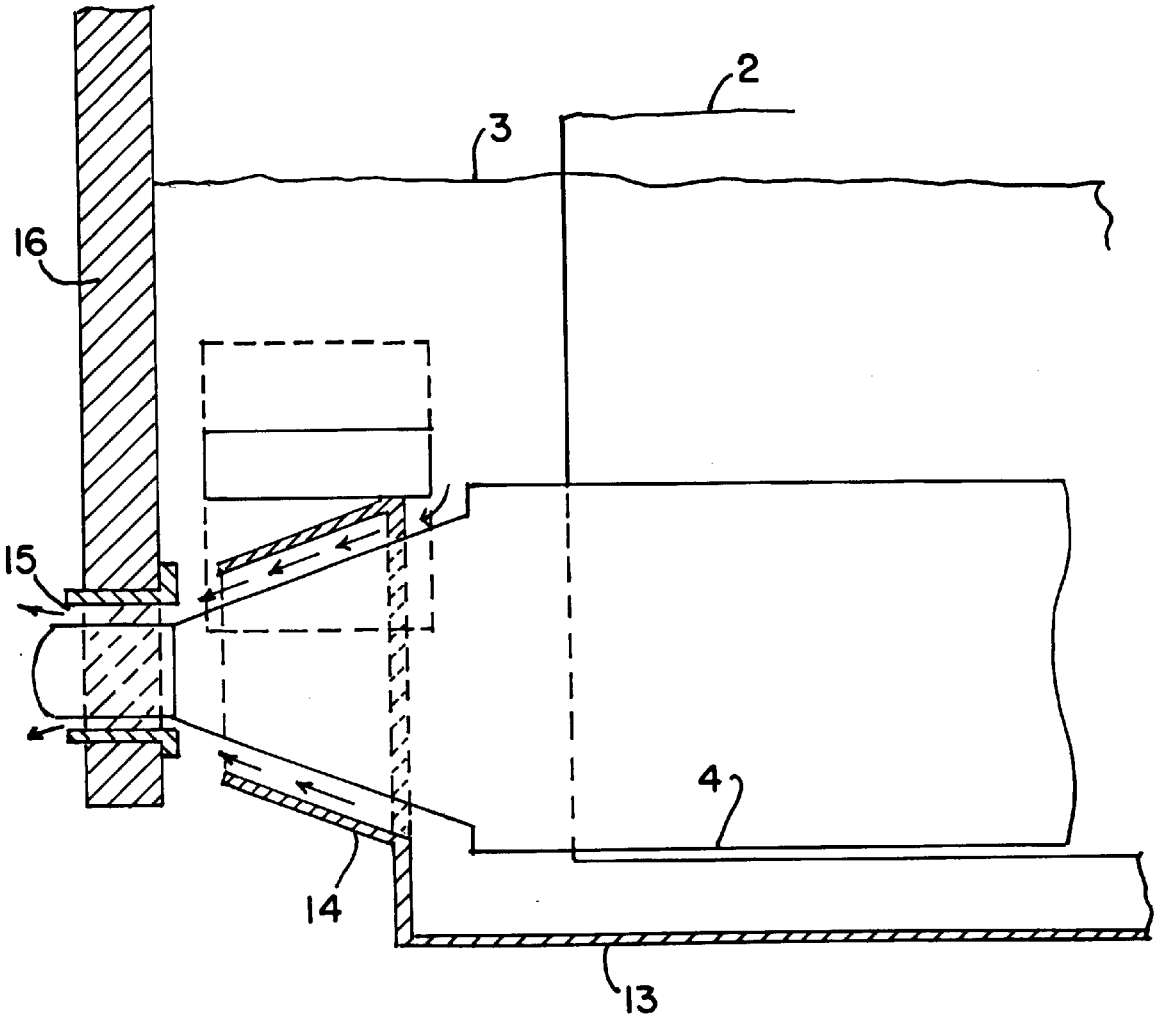
Figure 4:
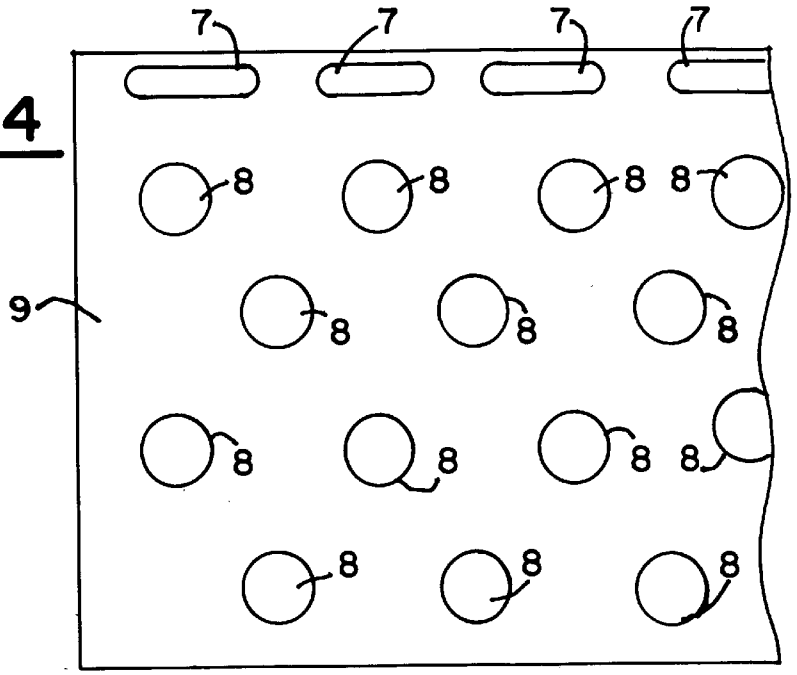
FIG. 4 is a schematic diagram depicting a baffle-plate or plenum containing nozzles.
Figure 5B:
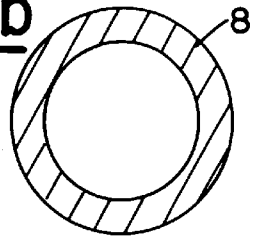
FIGS. 5(*a*) and (*b*) are schematic diagrams depicting two views of the nozzles used to inject the zinc along the length and both sides of the steel strip.
Figure 5A:
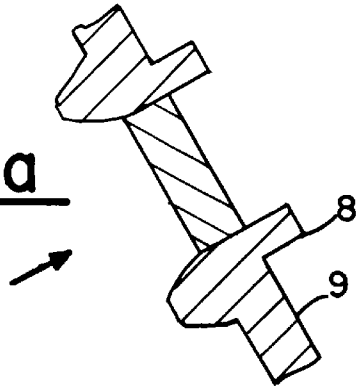
Figure 3:
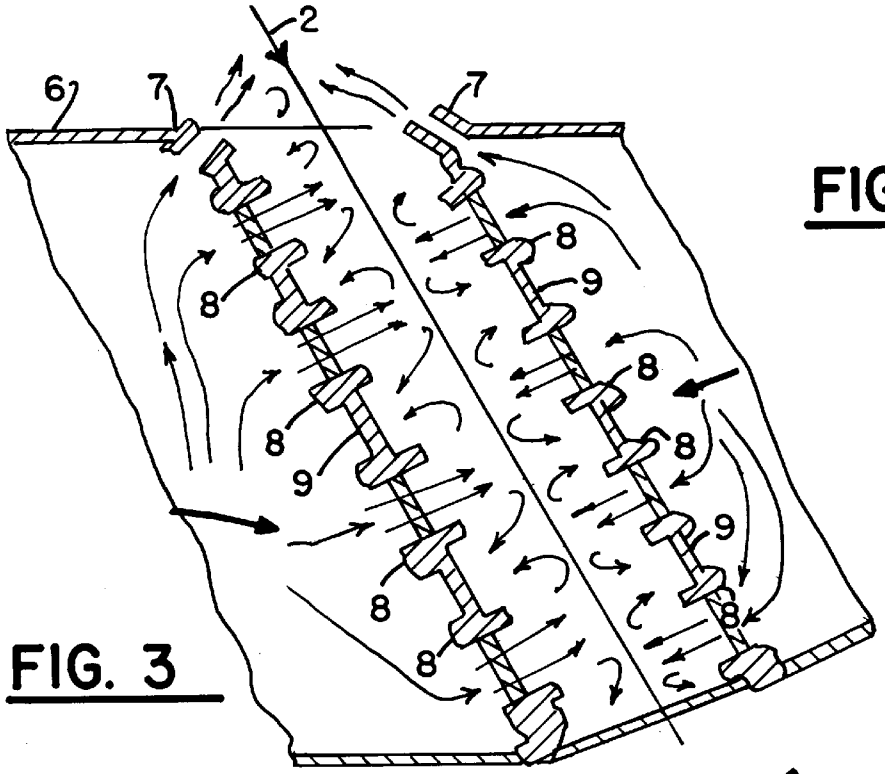
FIG. 3 is a schematic diagram depicting the nozzle chamber of the system of the present invention, and the fluid flow that occurs when carrying out the method of the present invention.

FIGS. 2(*a*) and 2(*b*) depict the overall system used to practice the present invention. As part of the inventive process an annealed steel strip 2 travels through a zinc bath 3 around the sink roller 4 and between one or more stabilizing rollers 5. The nozzle unit 6, which applies zinc to the steel, includes upper nozzles 7 and lower nozzles 8 (as depicted in FIGS. 3 and 4). In contrast, the cooler of U.S. Pat. No. 4,971,842 has an upper nozzle 7 and a lower nozzle 8 both formed as slits evenly over the width of the unit 6 without the shadow configuration of plenum plate 9 (FIG. 4) which includes a plurality of nozzles 8 arranged to direct molten zinc at substantially 90° angles along a length of the strip. Further, the cooler/cleaner 2 of the present invention has a plurality of upper elongated nozzles 7, as shown in FIG. 4. Also, the lower nozzles 8 are round and formed in the configuration of plenum plate 9.

Figure 1:
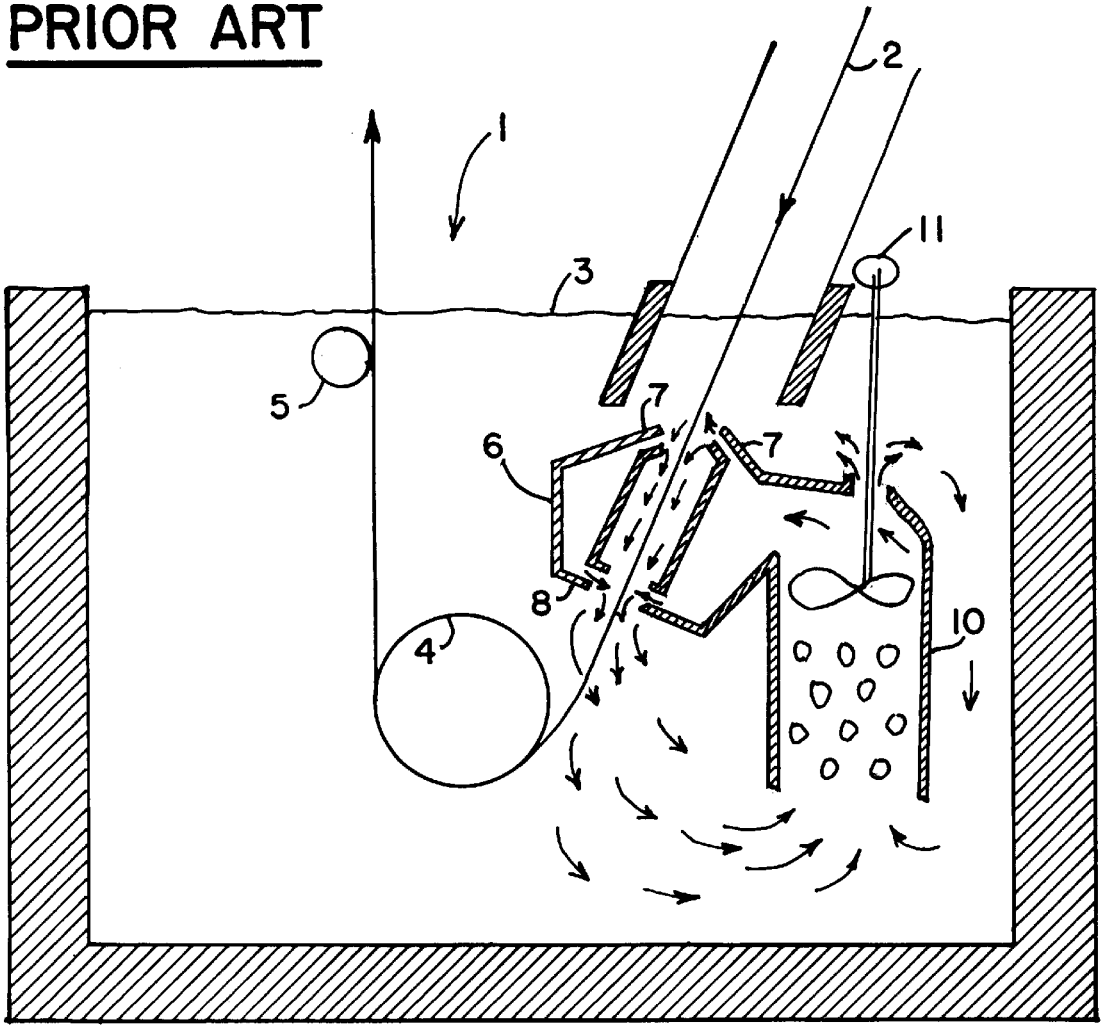
FIG. 1 PRIOR ART
FIG. 1 is a schematic diagram depicting the flow pattern of the system described in U.S. Pat. No. 4,971,842.

The discharge area of the nozzles 7 and 8 should cover at least 50% of the area of steel strip 2 along length of A to B of the steel strip 2 as depicted in FIG. 2(*a*). This is in contrast to the single lower nozzle 8 as described in U.S. Pat. No. 4,971,842 and depicted in FIG. 1. In the system of the present invention the nozzles 8 are mounted in the plenum plate 9 so that a half of the length of the nozzle is on one side and the other half of the other side of the middle-line of the plenum plate. This arrangement provides the most efficient flow of zinc against the steel sheet.

Inside the nozzle chamber 6 the dross contaminated zinc is pumped towards the steel strip in order to adhere the dross particles to the surface of the steel strip 2. This action removes the dross out of the zinc bath as part of the zinc coating on the steel strip. As a result, subsequently processed steel is handled in a dross-free zinc bath since all of the dross has been taken out by adhering to the previously processed steel strips. In order to adhere dross particles effectively to the steel strip, the zinc flow from the nozzles 8 should be directed to strike the strip from a virtually perpendicular direction rather than moving parallel to the strip as is the case for the cooler of U.S. Pat. No. 4,971,842 depicted in FIG. 1.

In order to develop sufficient flow to adhere dross particles to strip 2, the area of the nozzles 8 of the invention should be the same as twice the area of pump housing 10 as measured at agitator 17. By regulating the speed of rotation of the pump, and thus, the volume of material being moved, the velocity of the zinc flow from the nozzles 7 and 8 can be adjusted. The amount of zinc moved to the steel strip 2 can be monitored and controlled by diversion of material (approximately 2% of the total zinc in the bath) from a column of zinc through a slit 12 in housing 11 above the surface 3 of the zinc bath. The slit 12 is preferably 25 mm wide and 100 mm high. Housing 11 is attached to pump housing 10 and extends from below the surface of the zinc bath and extends above the surface of the zinc bath. The zinc level in the slit is diverted from the main zinc flow created by the pump 10, but is indicative of the proper zinc level in the overall bath. Further, by adjusting small amounts of zinc by diverting them from or adding them to the main flow of zinc applied to the steel, it is possible to precisely adjust the levels of zinc for optimum plating and the generation of the least amount of dross. This control device is absent from U.S. Pat. No. 4,971,842.

Preferably 5 mm column of zinc (above the surface 3 of the bath) correlates with the pumping of 1000 tons of zinc per hour, and a 10 mm column is suitable for 2000 tons of zinc per hour. Below 5 mm the zinc flow is too small and above 10 mm the zinc flow is too high creating material erosion problems. Thus, the zinc flow of the invention is assured by maintaining a column of zinc preferably equal to 5 mm to 10 mm at slit 12.

Figure 6A:
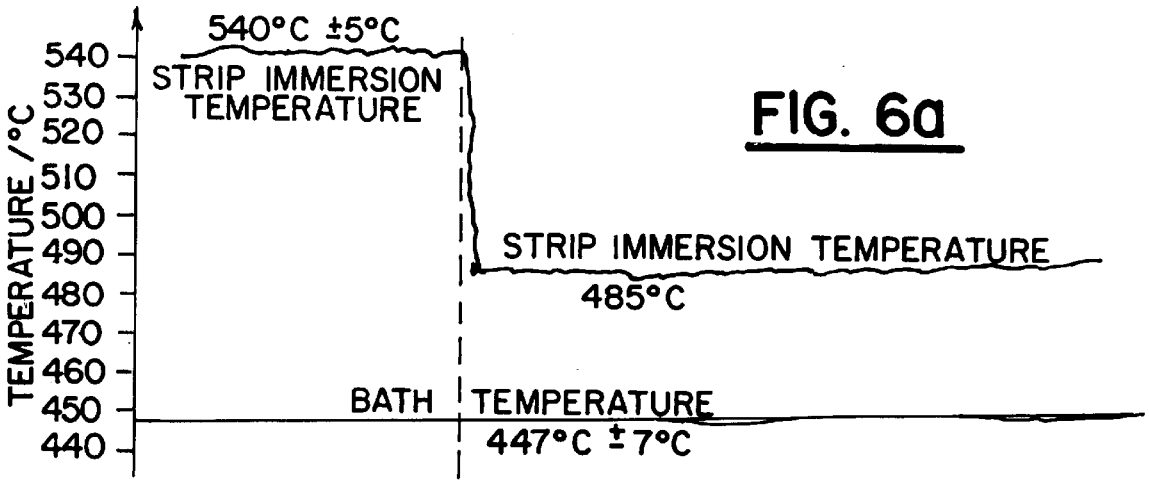
FIGS. 6(*a*), 6(*b*), and 6(*c*) are process diagrams depicting a comparison of various operational aspects of the conventional art and the present invention.
Figure 6B:
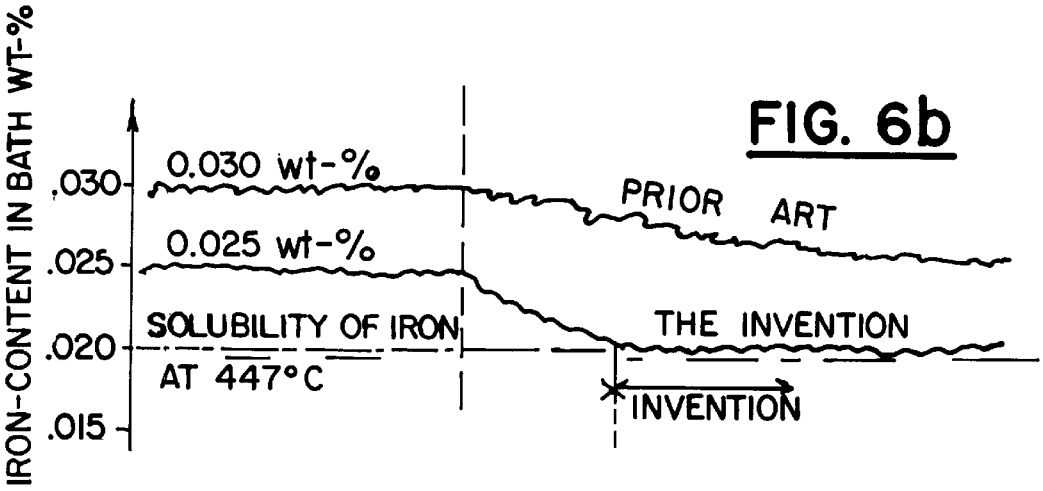
Figure 6C:
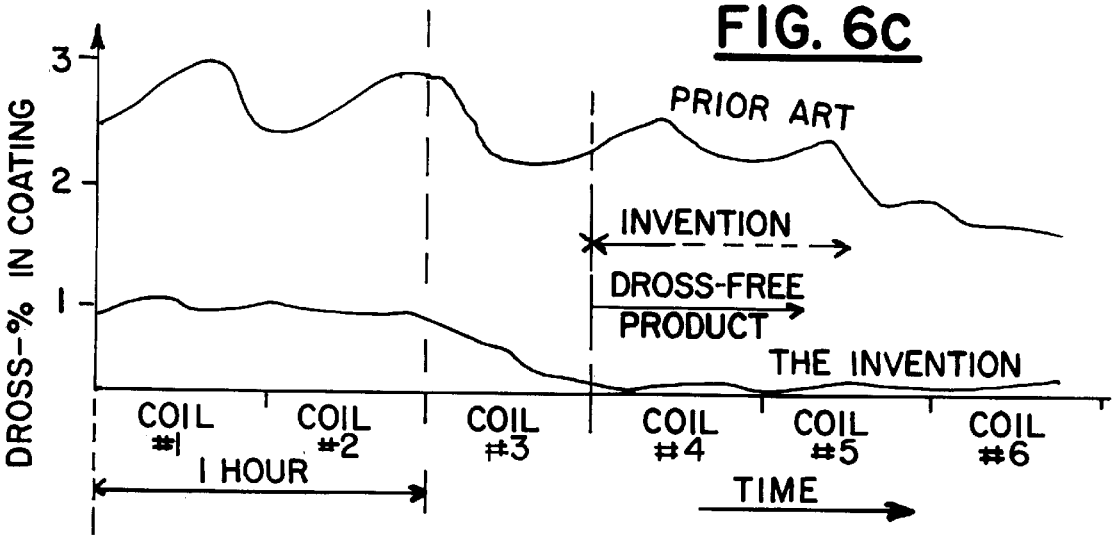

After the processing of three steel coils, as indicated in FIG. 6(*c*), the zinc coming out of the nozzle unit 6 is a virtually dross free zinc melt, because virtually all the dross particles have adhered to the steel strip 2 of previously processed coils. Therefore, the zinc flow on either side and below roller 4 cannot create any dross build-up on the roller 4. Nor is there any further dross deposited on strip 2.

The baffle plate 13 is below the lower roller 4. This zinc flow will keep the surface of the lower roller 4 clean, and prevents any dross build up on it. Thus, no mechanical scraper is required, as is necessary with the conventional systems, to remove dross build up from the roller. A cone 14 (FIG. 2(*b*)) at the end of the baffle 13 directs a part of the dross free zinc flow to the bearing 15 of the sink roller 4 attached to the arm 16. This flow minimizes roller bearing erosion/wear due to hard dross particles that may be in the bath during early stages (first three coils) of processing.

The division of the volume of zinc V handled by pump 10 is illustrated in FIG. 2(*a*). Approximately 40% of the volume of the zinc handled by the pump flows underneath lower roller 4, while approximately 30% flows over the roller. Approximately 15% of the volume of zinc handled by the pump flows out of the top of the nozzle unit 6 on each side of steel strip 2. All of this volume of zinc flows back through the pump, and constitutes approximately 98% of the zinc in the bath. The other 2% is diverted to housing 11, flowing through slit 12.

The area of all of the nozzles 7 and 8 should be substantially equal to twice the area of pump housing 10. Consequently, the zinc flow out of slit 12 is indicative of the critical incremental amounts of zinc that should be available in the bath to achieve the proper process that will result in a dross-free bath and eventually a dross-free product.

The nozzles 8 of the invention are preferably tubular with a diameter of between 70–100 mm and a length more than 0.7 of the diameter of the nozzle. The material of the material of the unit 6 is AISI 316 L (cast) or DIN 1,449. However, it is most important for the unit 6 to be a fully austenitic structure, i.e. ferrite free and the amount of ferrite should be less than 0.2%. Also the material should be cast formed without any bending or cold forming after casting.

The apparatus of the present invention will create the flow pattern as shown in FIG. 2 without any "dead" zones in the zinc bath 3 and with chemical uniformity throughout the zinc bath. This flow pattern makes it possible to achieve a method of performing hot-dip galvanizing with a dross free zinc bath composition. The flow patterns of conventional system and the system such as that shown in FIG. 1, have been insufficient to provide adequate chemical homogeneity, and so cannot achieve a dross-free bath composition and the resulting dross-free product.

The results of these tests on one preferred embodiment of the present invention are provided below and in FIGS. 6(*a*)-6(*b*) to illustrate some of the specific details of the inventive system and the process of operating it to galvanize steel strip. Industrial scale trials have been carried out to compare the cooler of U.S. Pat. No. 4,971,842 with the cooler/cleaner of the present invention. If the strip immersion temperature is too high, the reactivity of the bath will become too high, resulting in suspended dross. The system of the present invention operates to achieve the dross-free bath and subsequent dross-free product at reasonable strip immersion temperatures, preferably 485°–500° C. for the temperature of the steel strip and 440°–450° C. for the bath temperature.

As shown in the Table I the new cooler/cleaner can produce a product with dross free (0% dross) coating.

TABLE I

| | Conventional Cooler | | Inventive Cooler/Cleaner | |
|---|---|---|---|---|
| Strip immersion | 540° C. | 485° C. | 540° C. | 485° C. |
| Bath temperature | 447° C. | 447° C. | 447° C. | 447° C. |
| Aluminum content in bath | .15% | .15% | .14% | .14% |
| Iron content in bath | .03% | .025% | .025% | .020% |
| Dross-% in coating (by line inspector) | 2–3 | 1–2 | 1 | 0 |

The aluminum and iron content have been measured by chemical analysis from the samples taken out of the zinc bath. The solubility of iron to zinc at 447° C. is 0.020 wt-% when aluminum content is 0.14%. Thus the iron content of the bath is equal to the solubility of iron. As a result the method of the invention is capable of maintaining a dross-free zinc bath to produce a dross free product.

The three graphs of FIGS. 6(*a*)–(*c*) depict the results of using the present invention as opposed to those occurring when the system of U.S. Pat. No. 4,971,842 is used. In particular, the effectiveness (effectiveness=dross removal per unit time) of the system of the present invention is superior compared to that of U.S. Pat. No. 4,971,842. This is illustrated by the graph in FIG. 6(*c*), illustrating dross removal over a period of time, for a plurality of coils being processed. Each of the coils is approximately 20 tons of steel and takes approximately 30 minutes to process. By the time the third coil is processed, the operation of the present invention is such as to rapidly remove dross particles from the zinc bath. Subsequently, coil 4 becomes the first coil processed in a dross-free environment, which is the object of the present invention. This result has been impossible to achieve with the system of U.S. Pat. No. 4,971,842.

Although preferred embodiments have been described by way of example, the present invention should not be construed as being limited thereby. Consequently, the present invention should be considered to include any and all equivalents, modifications, variations and other embodiments limited only by the scope of the appended claims.

I claim:

1. A method of hot-dip galvanizing that eliminates substantially all suspended dross particles generated by galvanizing a metal strip to be coated, said method comprising the steps of:

(a) inserting said metal strip into a bath containing galvanizing materials; and (b) adhering substantially all said dross to said metal strip by forcing substantially perpendicular zinc flows against said metal strip using a plurality of nozzles on each side of said metal strip wherein said zinc flows agitates said entire zinc bath and maintains chemical homogeneity throughout said zinc bath.

2. The method of claim 1 wherein, step (a) comprises the sub-step of:

(i) controlling said metal strip by means of a lower roller in said bath.

3. The method of claim 2, wherein said flows of zinc are constituted by a plurality of streams moving perpendicularly to said surfaces of said metal strip at a plurality of locations along a predetermined length of said metal strip.

4. The method of claim 3, wherein said perpendicular streams encompass at least ½ an area on each side of said metal strip as measured along said metal strip from a point where said metal strip passes through a surface of said bath to a point at which said metal strip first contacts said lower roller.

5. The method of claim 2, further comprising:

(c) directing a zinc flow to said metal strip above and below said lower roller.

6. The method of claim 5, wherein said lower roller is supported by an arm having a bearing and said zinc flow is also directed to said bearing.

7. The method of claim 1, wherein said zinc bath is maintained so that iron content in said zinc bath is adjusted to a point where all dissolved iron is completely soluble in said zinc bath.

8. A system for carrying out a hot-dip galvanizing process of a steel strip in a zinc bath while maintaining said zinc bath in a substantially dross-free state, said system comprising a zinc bath through which a steel strip is passed, and a plurality of nozzles arranged in said bath on either side of said steel strip for directing zinc flows to said steel strip at a substantially perpendicular angle so that substantially all dross adheres to said steel strip and said zinc flows agitates said entire zinc bath and maintains chemical homogeneity throughout said zinc bath.

9. The system of claim 8, wherein said plurality of nozzles are mounted on plenum plates arranged on either side of said steel strip being processed in said zinc bath.

10. The system of claim 9, wherein said nozzles are arranged to provide flows of zinc substantially perpendicular to said steel strip on both sides of said steel strip at a plurality of locations along a predetermined length of said steel strip.

11. The system of claim 10, wherein each of said nozzles is bisected by said plenum plate.

12. The system of claim 11, further comprising:

(b) a lower roller arranged to handle said steel strip; and, (c) guide means for directing zinc flow above and below said lower roller.

13. The system of claim 12, wherein said nozzles comprise circular nozzles and elongated slots, said elongated slots being arranged along upper peripheries of said plenum plates.

14. The system of claim 13 wherein said circular nozzles are arranged to have a length and a diameter, where the length is equal to or greater than 0.7× diameter.

15. The system of claim 14, wherein said nozzles are arranged to expose said steel strip to zinc flow along a predetermined length of said steel strip, substantially equal to or greater than a length of said steel strip extending from a surface of said zinc bath to a point on said lower roller at which steel strip first contacts said lower roller.

16. The system of claim 15 wherein said nozzle material is constituted by an austenitic steel composition.

* * * * *